US007703357B1

(12) United States Patent
Shyu

(10) Patent No.: US 7,703,357 B1
(45) Date of Patent: Apr. 27, 2010

(54) ROTATABLE HANDLE ARRANGEMENT FOR A TORQUE-ADJUSTABLE WRENCH

(76) Inventor: Jun-Tsai Shyu, 8F., No. 68, Yusian Rd, Taiping (TW) 411

( * ) Notice: Subject to any disclaimer, the term of this patent is extended or adjusted under 35 U.S.C. 154(b) by 0 days.

(21) Appl. No.: 12/421,634

(22) Filed: Apr. 9, 2009

(51) Int. Cl.
*B25B 23/159* (2006.01)

(52) U.S. Cl. ..... 81/478; 81/483

(58) Field of Classification Search ..... 81/478, 81/467, 483
See application file for complete search history.

(56) References Cited

U.S. PATENT DOCUMENTS 4,541,313 A * 9/1985 Wise ..... 81/478
6,334,377 B1 * 1/2002 Wu ..... 81/478
6,948,410 B1 * 9/2005 Larson ..... 81/467
6,978,705 B1 * 12/2005 Lee ..... 81/467
7,044,036 B1 * 5/2006 Salazar et al. ..... 81/483
7,222,559 B2 * 5/2007 Wang ..... 81/467

* cited by examiner

*Primary Examiner*—David B Thomas

(57) ABSTRACT

A rotatable handle arrangement for a torque-adjustable wrench including a hollow sleeve fixed at a distal end of the moment arm by a fixing element. An internal toothed portion is formed in a stepped hole of the hollow sleeve and positioned adjacent to one side of the in-place-rotatable handle. In the normal state, the internal toothed portion is engaged with an external toothed portion of the in-place-rotatable handle by means of an elastic element. The torque-adjustable rod of a torque adjusting mechanism is driven by the in-place-rotatable handle for adjusting the torque value when the in-place-rotatable handle is pushed in the direction of the hollow sleeve so as to disengage the internal and external toothed portions from each other. In this way, an expected adjustment is achieved. After the adjustment, the external force is released and the internal and external toothed portions are automatically restored in an engaged and locked position (of the normal state) by means of the self-resilience of the elastic element.

3 Claims, 5 Drawing Sheets

ROTATABLE HANDLE ARRANGEMENT FOR A TORQUE-ADJUSTABLE WRENCH

BACKGROUND OF THE INVENTION

1. Fields of the Invention

The invention relates to a rotatable handle arrangement for a torque-adjustable wrench, and more particularly, to a structure that ensures a more easy operation and a more practical use.

2. Description of the Related Art

A torque-adjustable wrench refers to a special ratchet wrench capable of adjusting the torque value. The ratchet mechanism will be turned into idle state when the force applied exceeds a preset value. In this way, the workpiece is protected from damage due to the application of an excessive force. The ratchet and the torque setting mechanism are conventional components and well known to the public so that no further descriptions thereto are given hereinafter.

As shown in FIG. 6, a conventional torque-adjustable wrench 10 includes a ratchet drive portion 12 with an insertion member 11, a moment arm 13, and a twist handle 14. In adjusting the torque value, a locking element 15 at the tail of the twist handle 14 has to be loosened first. In this way, the twist handle 14 can be twisted for adjusting or setting the torque adjusting mechanism (not shown). After the adjustment, the locking element 15 has to be tightened in place so as not to change the originally set value due to an unexpected twist of the twist handle 14.

No matter if it refers to the above-mentioned conventional torque-adjustable wrench 10 or an electronically torque-adjustable wrench (not shown), it is necessary to unlock and lock a locking mechanism for adjusting the torque value, thereby causing much trouble and inconvenience for the operators.

SUMMARY OF THE INVENTION

An object of the invention is to provide a rotatable handle arrangement for a torque-adjustable wrench that employs a hollow sleeve having an internal toothed portion 30 in cooperation with a rotatable handle (having an external toothed portion) and an elastic element. In this way, it is only required to move the in-place-rotatable handle for conducting the adjustment of the torque value. Meanwhile, the conventional locking element is not needed any more. As a result, a practical operation and an easy use are ensured.

According to the invention, a rotatable handle arrangement for a torque-adjustable wrench includes a hollow sleeve fixed at a distal end of the moment arm by a fixing element. An internal toothed portion is formed in a stepped hole of the hollow sleeve and positioned adjacent to one side of the in-place-rotatable handle. In the normal state, the internal toothed portion is engaged with an external toothed portion of the in-place-rotatable handle by means of an elastic element. The torque-adjustable rod of a torque adjusting mechanism is driven by the in-place-rotatable handle for adjusting the torque value when the in-place-rotatable handle is pushed in the direction of the hollow sleeve so as to disengage the internal and external toothed portions from each other. In this way, an expected adjustment is achieved. After the adjustment, the external force is released and the internal and external toothed portions are automatically restored in an engaged and locked position (of the normal state) by means of the self-resilience of the elastic element.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
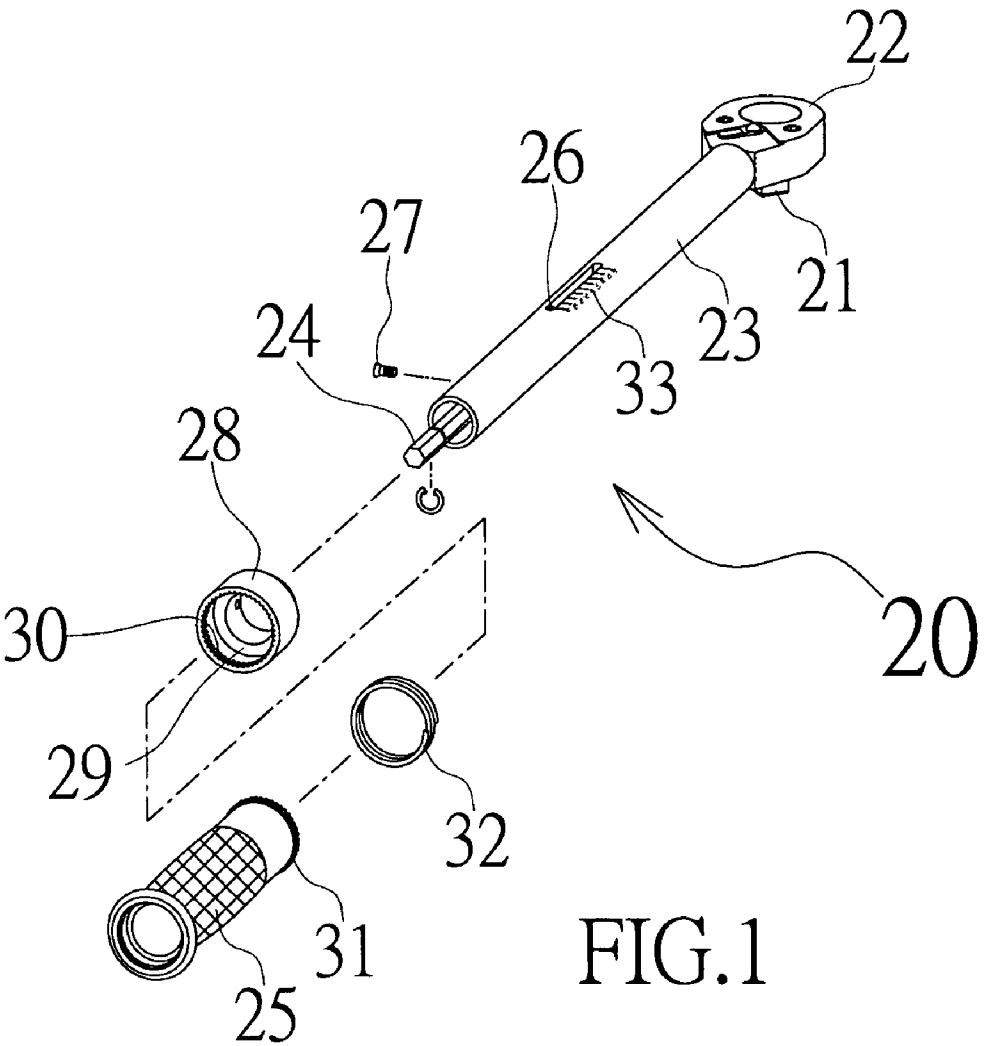
FIG. 1 is a perspective exploded view of a preferred embodiment of the invention.
Figure 2:
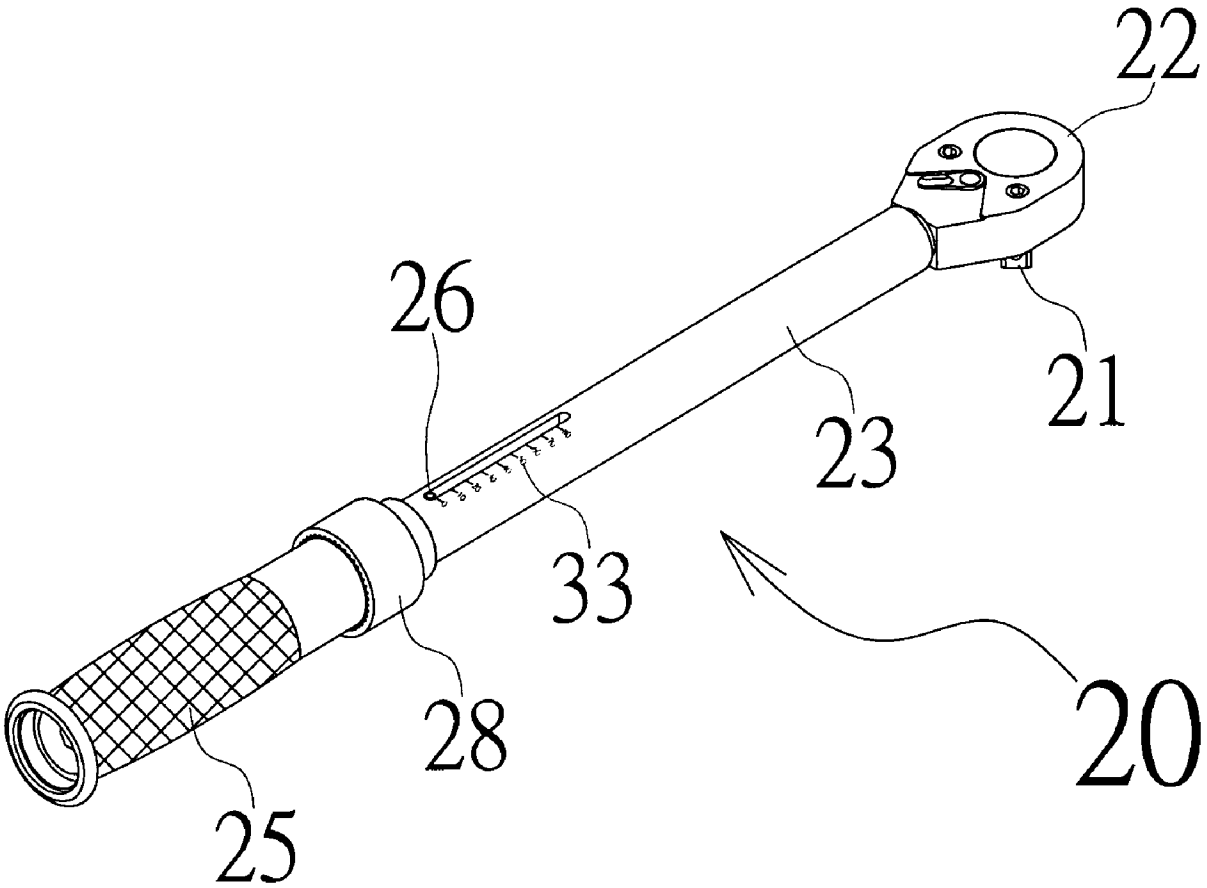
FIG. 2 is a perspective assembly view of the preferred embodiment of the invention according to FIG. 1.
Figure 3:
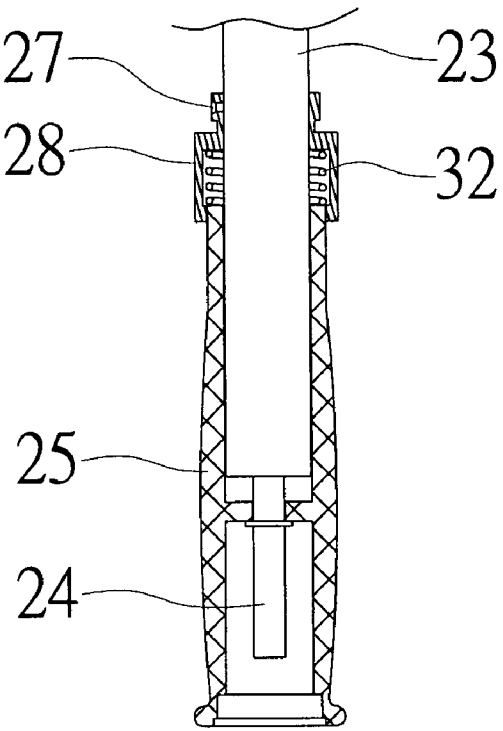
FIG. 3 is a partially cross-sectional view of the embodiment according to FIG. 2.

Referring to FIGS. 1 through 3, a torque-adjustable wrench 20 in accordance with a preferred embodiment of the invention includes a ratchet drive portion 22 with an insertion member 21, a moment arm 23, a torque-adjustable rod 24, an in-place-rotatable handle 25, and a torque setting pointer 26. A hollow sleeve 28 is fixed at a distal end of the moment arm 23 by a fixing element 27. An internal toothed portion 30 is formed in a stepped hole 29 of the hollow sleeve 28 and positioned adjacent to one side of the in-place-rotatable handle 25. In the normal state, the internal toothed portion 30 is engaged with an external toothed portion 31 of the in-place-rotatable handle 25 by means of an elastic element 32.

Figure 4:
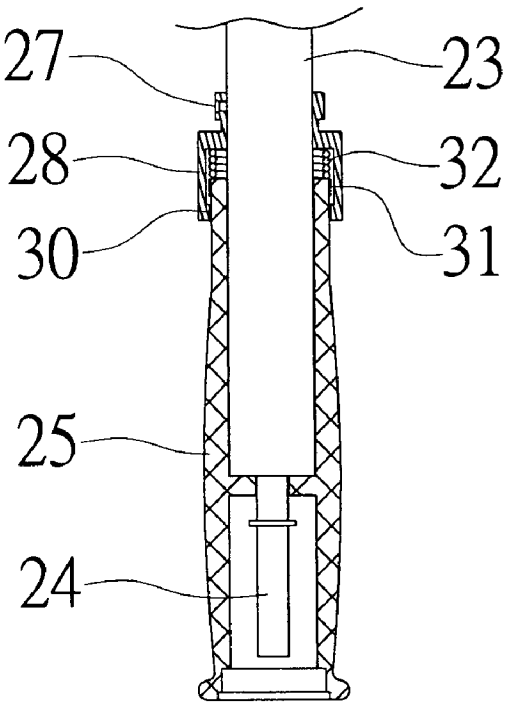
FIG. 4 is a schematic drawing of the operation of the embodiment according to FIG. 3.

As shown in FIG. 4, the torque-adjustable rod 24 of a torque adjusting mechanism (not shown) can be driven by the in-place-rotatable handle 25 for adjusting the torque value when the in-place-rotatable handle 25 is pushed in the direction of the hollow sleeve 28 so as to disengage the internal and external toothed portions 30, 31 from each other. In this way, an expected adjustment is achieved. After the adjustment, the external force is released and the internal and external toothed portions 30, 31 are automatically restored in an engaged and locked position (of the normal state, as shown in FIG. 3) by means of the self-resilience of the elastic element 32.

The torque setting pointer 26 will be moved when the torque-adjustable rod 24 is driven by the in-place-rotatable handle 25 in rotation. In this way, the torque setting value can be determined by use of a scale 33 in proximity to the torque setting pointer 26.

The above-mentioned torque adjusting mechanism is disposed within the torque-adjustable wrench 20 for adjusting the torque value by use of the handle 25 and the torque setting pointer 26. The torque adjusting mechanism is a conventional common component and not the object of the invention so that no further descriptions thereto are given hereinafter.

Figure 5:
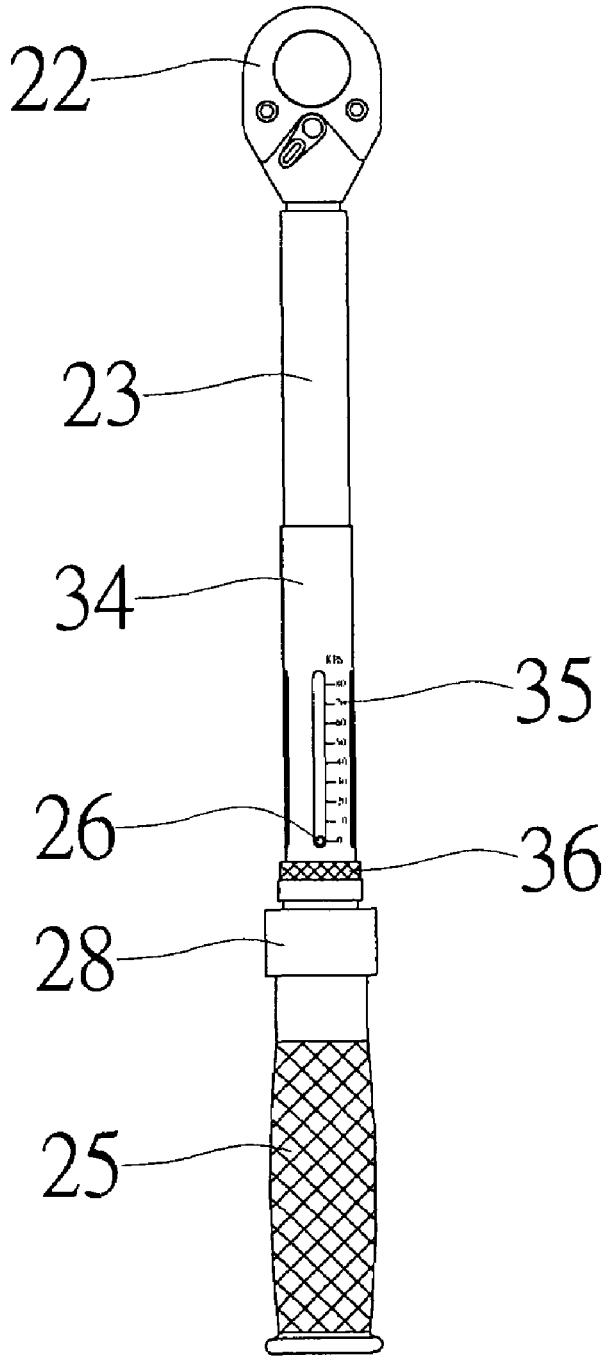
FIG. 5 is a schematic drawing of another embodiment of the invention.
Figure 6:
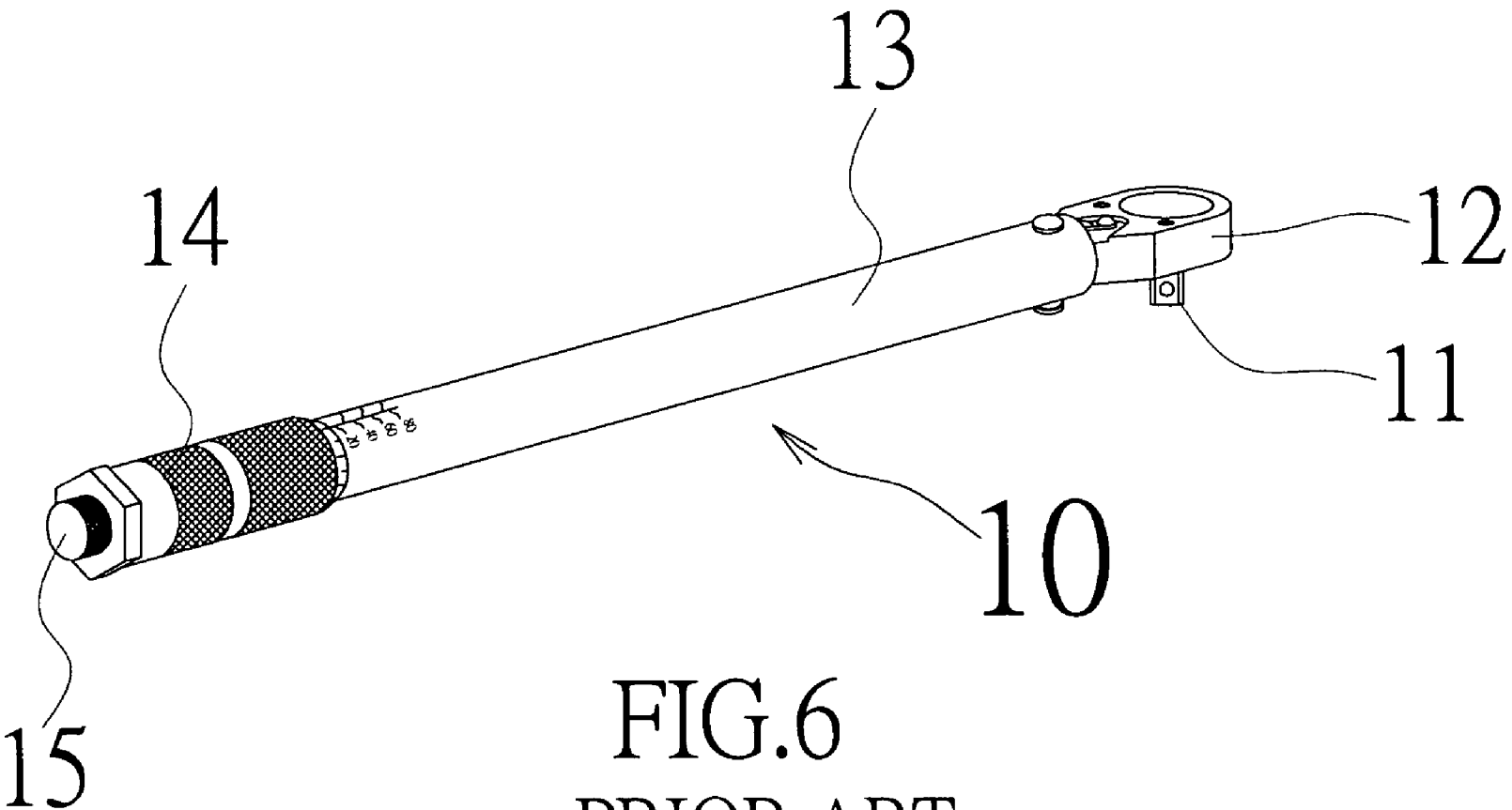
FIG.6 PRIOR ART
FIG. 6 is a perspective view of a conventional torque-adjustable wrench.

As shown in FIG. 5, a scale sleeve 34 is in-place-rotatably mounted on the moment arm 23 of the torque-adjustable wrench 20. A plurality of standard torque scales 35 (including a British system, a metric system, and an international standard metric system) are fitted to the surface of the scale sleeve 34. By rotating the scale sleeve 34 in alignment to the torque setting pointer 26, the operator may select one of the torque scales 35 at will. In order to facilitate the rotation of the scale sleeve 34, a projecting portion 36 is positioned at one end of the scale sleeve 34 such that the fingers of the operator easily hold the projecting portion 36 and apply force thereto. In this way, a convenient operation and a practical use are achieved. In other words, no matter which torque scale 35 is used, it is only required to rotate the scale sleeve 34 to align the applied scale to the torque setting pointer 26. In this way, a smooth use is ensured.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A rotatable handle arrangement for a torque-adjustable wrench, wherein the torque-adjustable wrench includes a ratchet drive portion with an insertion member, a moment arm, a torque-adjustable rod, a in-place-rotatable handle, and a torque setting pointer; and wherein a hollow sleeve is fixed at a distal end of the moment arm by a fixing element;

wherein an internal toothed portion is formed in a stepped hole of the hollow sleeve and positioned adjacent to one side of the in-place-rotatable handle;

wherein the internal toothed portion is, in the normal state, engaged with an external toothed portion of the in-place-rotatable handle by means of an elastic element located between the in-place-rotatable handle and the hollow sleeve, the elastic element having one end abutting the stepped hole of the hollow sleeve;

wherein the torque-adjustable rod of a torque adjusting mechanism is driven by the in-place-rotatable handle for adjusting the torque value when the in-place-rotatable handle is pushed in the direction of the hollow sleeve so as to disengage the internal and external toothed portions from each other, thereby achieving an expected adjustment;

wherein, after the adjustment, the external force is released and the internal and external toothed portions are automatically restored in an engaged and locked position of the normal state by means of the self-resilience of the elastic element.

2. The rotatable handle arrangement for a torque-adjustable wrench as recited in claim 1, wherein a scale sleeve is in-place-rotatably mounted on the moment arm; and wherein at least one standard torque scale is fitted to the surface of the scale sleeve.

3. The rotatable handle arrangement for a torque-adjustable wrench as recited in claim 1, wherein the fixing element locks the hollow sleeve to the distal end of the moment arm and prevents the hollow sleeve from rotating or sliding with respect to the moment arm.

* * * * *